US005368125A

United States Patent [19]

St-Germain

[11] Patent Number: 5,368,125

[45] Date of Patent: Nov. 29, 1994

[54] PLATFORM RAISING SYSTEM IN SCAFFOLDING

[76] Inventor: André St-Germain, 2600 rue Portland, #304, Sherbrooke, Quebec, Canada, J1J 1V7

[21] Appl. No.: 46,575

[22] Filed: Apr. 16, 1993

[51] Int. Cl.[5] ..... E04G 1/20

[52] U.S. Cl. ..... 182/146; 182/132

[58] Field of Search ..... 182/145, 146, 131, 132, 182/118, 63, 136

[56] References Cited

U.S. PATENT DOCUMENTS

| | | |
|---|---|---|
| 279,740 | 6/1883 | Gillett . |
| 3,179,178 | 7/1965 | Nietz . |
| 3,318,414 | 5/1967 | Meek . |
| 3,323,616 | 6/1967 | Best . |
| 3,466,723 | 9/1969 | Durand . |
| 3,908,801 | 9/1975 | Pohlman . |
| 4,293,054 | 10/1981 | Pieri . |
| 4,294,332 | 10/1981 | Ready . |
| 4,418,791 | 12/1983 | Frey-Wigger . |
| 4,809,814 | 3/1989 | St-Germain . |
| 5,067,587 | 11/1991 | Mims, Jr. et al. . |

FOREIGN PATENT DOCUMENTS

| | | |
|---|---|---|
| 625646 | 4/1927 | France . |
| 1465517 | 12/1966 | France . |
| 2261387 | 9/1973 | France . |
| 2355764 | 7/1979 | France . |
| 532446 | 8/1931 | Germany . |
| 2342630 | 8/1973 | Germany . |
| 2721268 | 5/1977 | Germany . |
| 590423 | 7/1947 | United Kingdom . |
| 1163616 | 9/1965 | United Kingdom . |

*Primary Examiner*—Alvin C. Chin-Shue

*Attorney, Agent, or Firm*—Pierre Lespérance; Francois Martineau

[57] ABSTRACT

The scaffolding includes a tower provided with equally spaced rungs and adapted to be secured to an adjacent building structure, an outer sleeve surrounding the tower and guided therealong and a work platform supported by the outer sleeve. The raising system includes an inner sleeve surrounding and guided on the tower inwardly of the outer sleeve, a pair of latching levers pivoted to the outer sleeve and latching onto the tower, a pair of hydraulic rams pivoted to the outer sleeve and to the inner sleeve and reciprocating the latter for up and down movement relative to the outer sleeve, and a pair of hooks pivoted on the inner sleeve to engage and disengage opposite rungs of the tower. To raise the outer sleeve and work platform, the rams are retracted while the inner sleeve is hooked to the tower. When the ram retracting stroke is completed, the latching levers latch the outer sleeve to the tower and the rams extend to raise the inner sleeve which is then hooked to a higher pair of opposite tower rungs.

17 Claims, 11 Drawing Sheets

PLATFORM RAISING SYSTEM IN SCAFFOLDING

FIELD OF THE INVENTION

The present invention relates to self-raising platform assemblies and more particularly to the means for raising and lowering the platform.

BACKGROUND OF THE INVENTION

In applicant's prior U.S. Pat. No. 5,159,993 dated Nov. 3, 1992 and entitled SELF-RAISING WORK PLATFORM ASSEMBLY, there is described a pair of towers adapted to be erected alongside a building structure and anchored thereto, elongated sleeves surrounding said towers and guided for up and down movement therealong and work platforms extending between the towers and supported by the sleeve members. Power operated chain blocks are used for raising and lowering the sleeve members and platforms to the required working level. Such chain blocks must be attached to the tower at successively higher levels each time it is desired to raise the work platforms and the workmen must climb the tower to attach the chain blocks thereto. This procedure is sometimes considered dangerous for the workmen. The same chain block system is used in applicant's U.S. patent application No. 07/775,909 filed on Oct. 15, 1991, allowed on Dec. 9, 1992 and entitled SELF-RAISING CANTILEVER TYPE WORK PLATFORM ASSEMBLIES.

Such a disadvantage is overcome by the raising system described in U.S. Pat. No. 4,809,814 dated Mar. 7, 1989, inventor: Jean St-Germain, and entitled SCAFFOLDING. Referring to FIGS. 8 and 9 of this patent, it is seen that each tower is formed with a plurality of vertically equally spaced rungs 38 successively engaged by a hook 116 which is attached at the top end of a piston rod 112 of a hydraulic ram 106 pivoted at 110 to the platform 42 to be raised along the tower. Upon the return contraction stroke of the ram 106, the platform is held by the latching levers 84 engaging a tower rung. This system works well but it sometimes happens that the hook 116 fails to properly engage a tower rung. This was found to be produced by the fact that the hook 116 is not properly guided since only the lower end of ram 106 is attached and since the ram must have a certain length to permit sufficient vertical stroke of the hook 116 to move from one rung to the next one.

This malfunction may cause serious injuries to the workers which are high up above ground. Some self-raising work platform assemblies use a rack and pinion driving system to raise and lower the platform along the towers. Such a rack and pinion system requires a relatively high precision in the assembly of the parts and is quite expensive to build and operate.

OBJECTS OF THE INVENTION

The main object of the present invention is to provide a raising system for a self-raising work platform assembly which will obviate the above-noted disadvantages.

Another object of the invention is to provide a system of the character described which is fail-safe, which is relatively inexpensive to build, and which is users' friendly.

Another object of the invention is to provide a raising system of the character described which can raise or lower the platforms along the tower in a substantially continuous movement in spite of the fact that reciprocating power rams are used.

SUMMARY OF THE INVENTION

In a scaffolding of the type including a tower having equally spaced rungs, anchor means attached to and laterally protruding from the tower at vertically spaced points along the tower for attachment to an adjacent building structure, an outer sleeve partially surrounding the tower and guided for up and down movement along the same while clearing the anchor means, support means carried by the outer sleeve to support a work platform, a raising system comprising an inner sleeve located between the outer sleeve and the tower, also partially surrounding the tower for clearing the anchor means, at least two power rams pivotally connected at their ends to the outer and inner sleeves for effecting reciprocating up and down movement of the inner sleeve relative to the outer sleeve a distance at least equal to the distance between two vertically adjacent rungs, at least two hooks pivotally mounted on the inner sleeve and means to pivot the hooks between rung hooking and rung unhooking position, the hooks and power rams being spaced from each other respectively around the tower and further including latch means to latch the outer sleeve to the tower when the hooks are in rung hooking position.

Preferably, when the tower and the outer sleeve have a four-sided, quadrangular cross-section and the outer sleeve has a slit side to clear anchor means, the inner sleeve is equally four-sided and has a slit side to clear the anchor means and the power rams and the hooks are disposed on the two opposite sides of the sleeves which are normal to the slit side thereof. The tower engaging guiding means carried by both ends of the outer sleeve are spaced a sufficient distance to permit reciprocating up and down movement of the inner sleeve relative to the outer sleeve.

Preferably, in accordance with one embodiment, there are provided biasing means biasing the hooks towards their rung hooking position and each hook has a top inclined edge which causes movement of the hook towards its rung unhooking position upon engagement of the next upper rung to thus clear said next upper rung when the inner sleeve moves up along the tower. In this embodiment, a handle means is connected to the hooks to manually pivot the same from rung hooking to rung unhooking position.

Preferably, the rams are hydraulic rams and the invention further includes a power unit which is portable and includes an internal combustion engine, a hydraulic reservoir, a hydraulic pump driven by the engine and removably connected to the hydraulic rams, the power unit being removably carried by the outer sleeve.

Preferably, the hydraulic reservoir is constituted by some of the tubular frame members forming the outer sleeve.

In one embodiment, the latch means includes at least two latching levers pivoted intermediate their ends to the outer sleeve at spaced points around the outer sleeve, each latching lever having an inner branch and an outer branch extending inwardly and outwardly of the lever pivot respectively, the outer sleeve having an abutment outwardly of said pivot and in register with and below the outer branch, each lever being pivotable in a vertical plane between a rung latching position in which the inner branch overlaps and can rest on one of said rungs and said outer branch overlaps and rests on said abutment, and a rung unlatching position wherein the inner branch extends exteriorly of and clears said rungs. Preferably, there are provided biasing means attached to said latching levers and to said outer sleeve and biasing said latching levers towards latching position, a foot operated pedal means being provided to pivot the latching levers to unlatching position upon depression of the pedal means.

In an alternate embodiment, the hooks are not provided with the above noted handle means and biasing means but are pivoted between rung hooking and rung unhooking position by a double-acting hydraulic ram. Similarly, the latching levers are operated between rung latching and rung unlatching position by a double-acting hydraulic ram.

In a modified embodiment, the outer sleeve and platform may be raised or lowered along the tower in a continuous manner; to attain this result, the above raising system including the inner sleeve, the reciprocating power rams and the power-operated hooks is duplicated and arranged to work in alternating manner, the two systems alternately serving as latching means.

DETAILED DESCRIPTION OF THE PREFERRED EMBODIMENTS

Figure 1:
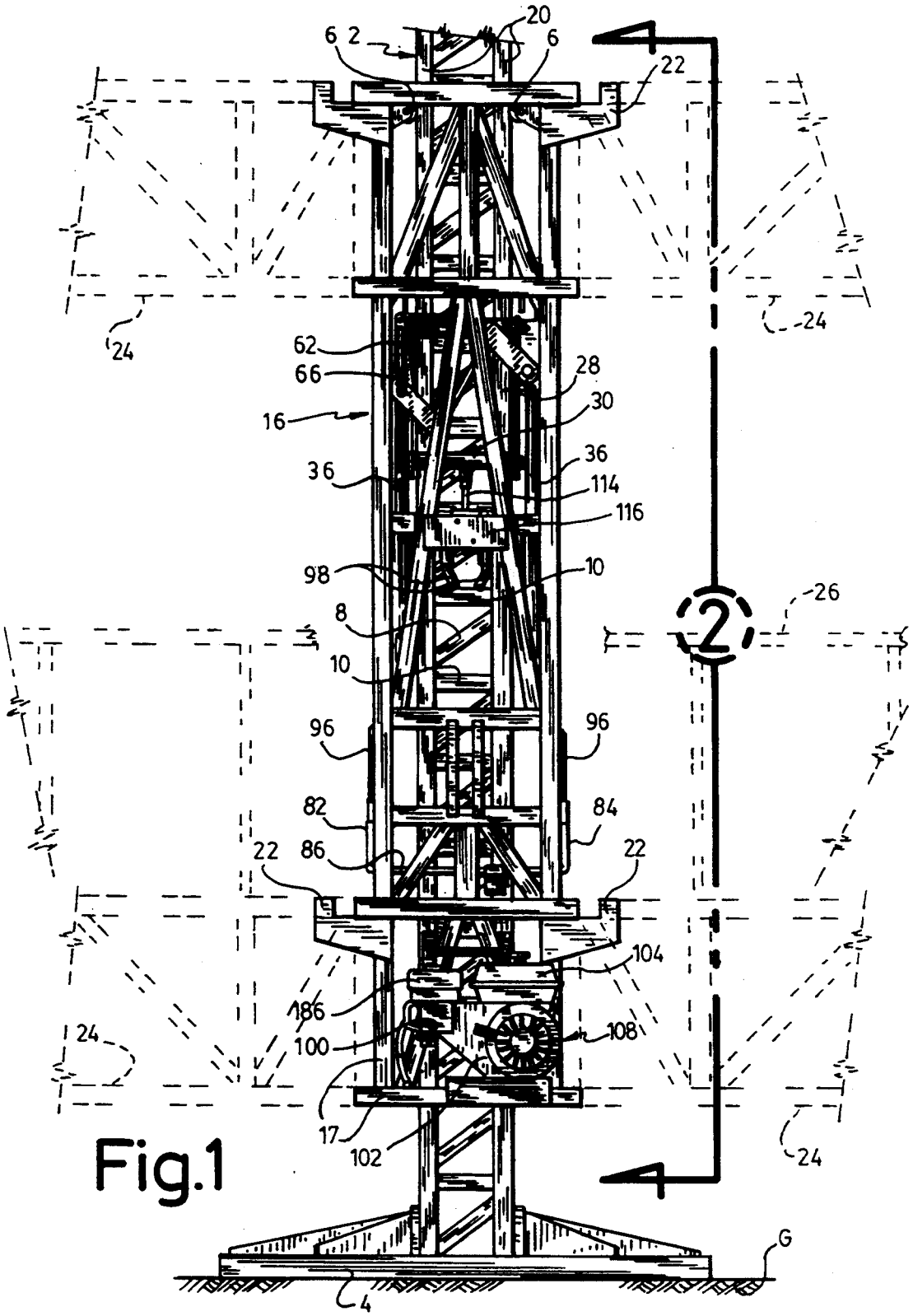
FIG. 1 is a partial front elevation of the assembly of an outer sleeve, an inner sleeve and the tower with the work platforms shown in dotted line.

The first embodiment of the invention is illustrated in FIGS. 1 to 9A inclusive. A tower 2 is removably mounted on a base 4 resting on the ground G adjacent a building structure partially shown in cross section at B in FIG. 2. The tower preferably has a square cross-section being formed of longitudinally extending angle irons 6 which are mutually interconnected by diagonal braces 8 on the front and back sides of tower 2 and by equally vertically spaced horizontal rungs 10 on the four sides of tower 2.. The tower is made of modular sections of equal length, bolted together as shown and described in applicant's U.S. patent application No. 07/775,909 filed on Oct. 15, 1991 and allowed Dec. 9, 1992 for a "SELF-RAISING CANTILEVER TYPE WORK PLATFORM ASSEMBLY". The tower 2 is fixed to the building structure B at vertically spaced points by anchor members 12 (see FIGS. 2, 3, and 4) which laterally protrude from the side of the tower 2 facing the building structure B and which are adapted to be anchored to the building structure by a suitable system indicated at 14 in FIG. 2.

As in the previously mentioned patent application, an elongated outer sleeve 16 of square cross-section, partially surrounds the tower 2, and its back side has a longitudinally extending slit 18 opening at both ends of the outer sleeve 16 which serves to clear the anchor members 12 when the outer sleeves 16 move up and down the tower. The outer sleeve 16 is guided along the tower by suitable guiding means, preferably as in the previously noted U.S. patent application, by guiding rollers 20 carried by the outer sleeve 16 at the top and bottom ends thereof and engaging each of the four angle irons 6 of the tower 2. The top and bottom end portions of the outer sleeve 16 carries upwardly opening hooks 22 and apertured ears 23 protruding from each side normal to the back side of the sleeve provided with the slit 18. These hooks 22 and ears 23 serve to support and secure joist sections 24 shown in dotted lines normally supporting a walkway and a guard rail 26 and forming the work platforms to be supported at the proper working level by the outer sleeve 16 along the tower 2. The work platforms 26 may be of the cantilever type or may extend between two towers. As in the previously mentioned patent application, the outer sleeve 16 is preferably long enough to carry two levels of platform 26 with a sufficient vertical distance between the same for workmen to conveniently work at two levels at the same time.

Figure 2:
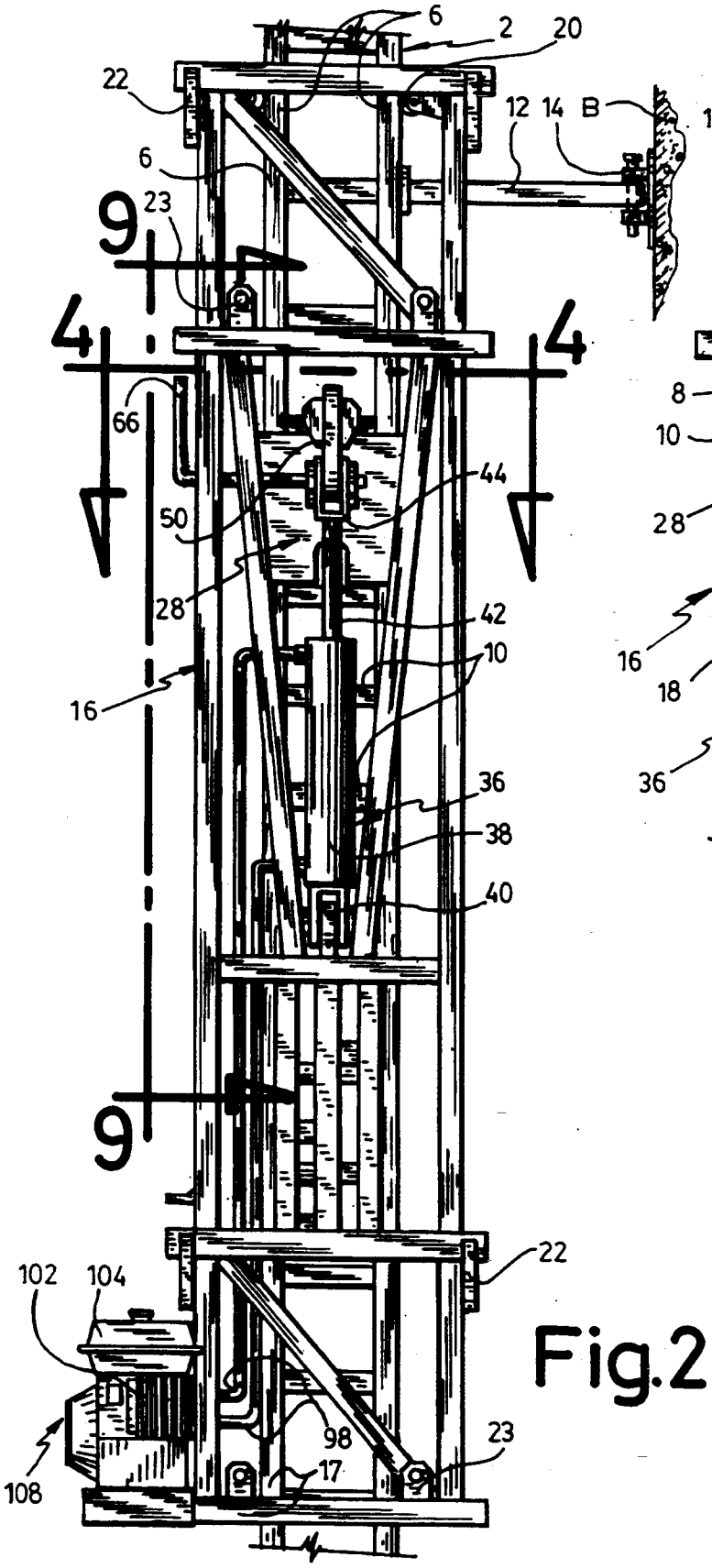
FIG. 2 is a side elevation taken along line 2 of FIG. 1.
Figure 3:
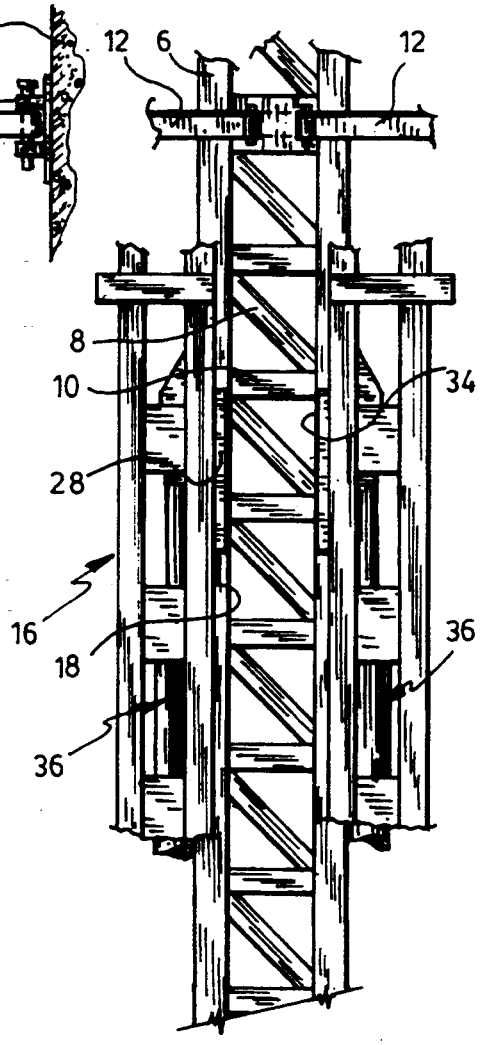
FIG. 3 is a partial back elevation looking at the right side of FIG. 2.
Figure 4:
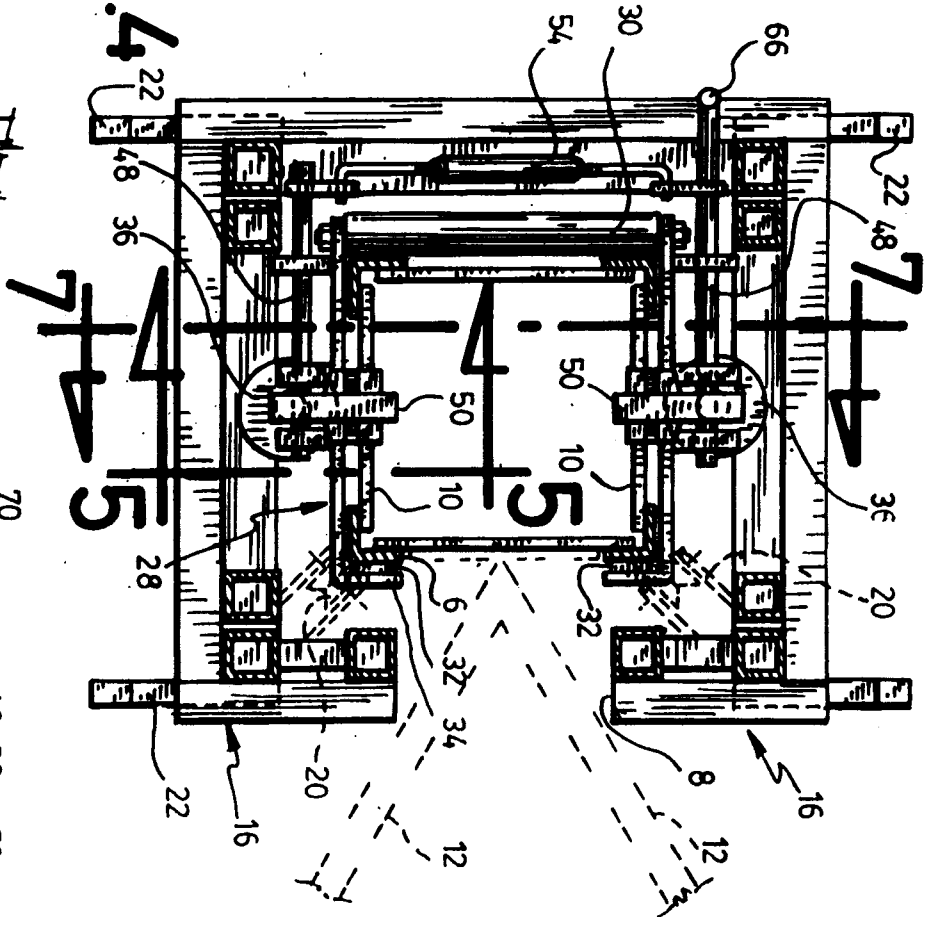
FIG. 4 a cross-section taken along line 4—4 of FIG. 2.

In accordance with the invention there is provided a new improved system for raising and lowering the outer sleeve 16 along the tower 2. This system, in accordance with the first embodiment, comprises an inner sleeve 28 which is disposed between the outer sleeve 16 and the tower 2 and which partially surrounds the tower 2 and is guided therealong by a top and bottom cylindrical rollers 30 in rolling engagement with the front angle irons 6 of the tower 2 as shown in FIG. 2 and by pads 32 at the back side of the inner sleeve which engage the back angle irons 6 of the tower 2, namely the angle irons on the side facing the building structure B. The inner sleeve 28 partially surrounds the tower 2 as the outer sleeve 16, its back side being formed by a longitudinally extending slit 34 opening at both ends of the inner sleeve 28 to clear the anchor members 12 during vertical movement of the inner sleeve along the tower 2. Inner sleeve 28 can be reciprocated up and down the tower 2 with respect to the outer sleeve 16 a distance at least equal to the distance separating two adjacent rungs 10, the guiding rollers 20 carried by the outer sleeve 16 being sufficiently vertically spaced to permit such a reciprocating movement of the inner sleeve 28.

Figure 5:
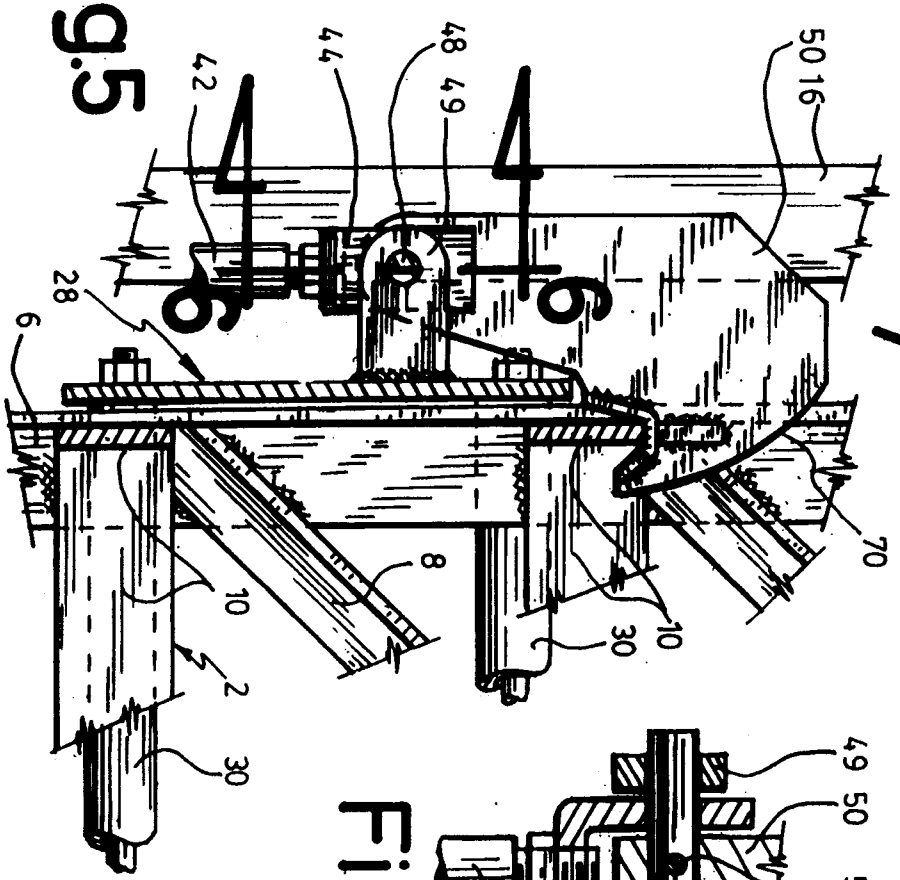
FIG. 5 is a partial vertical section taken along line 5—5 of FIG. 4.
Figure 6:
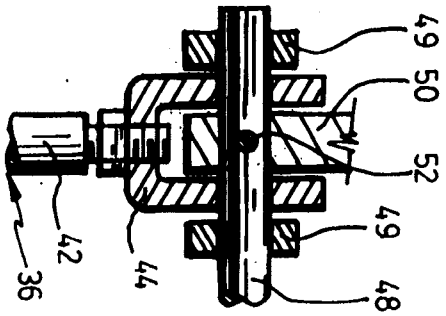
FIG. 6 is a partial cross-section taken along line 6—6 of FIG. 5.
Figure 7:
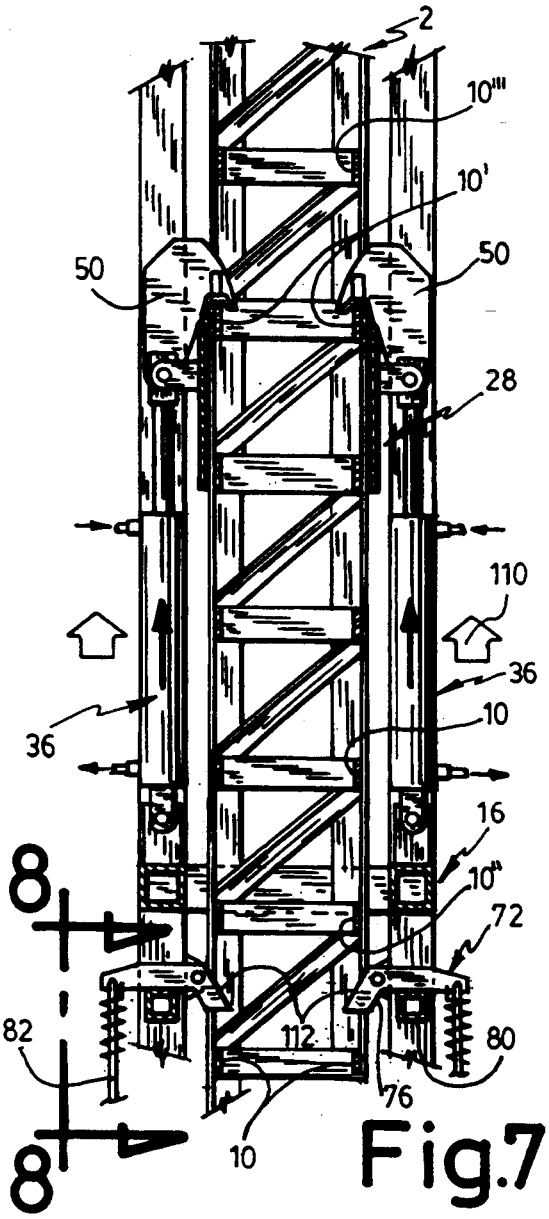
FIG. 7 and 7A are partial vertical sections taken along line 7—7 of FIG. 4 showing two successive stages during raising of the outer sleeve along the tower.
Figure 9:
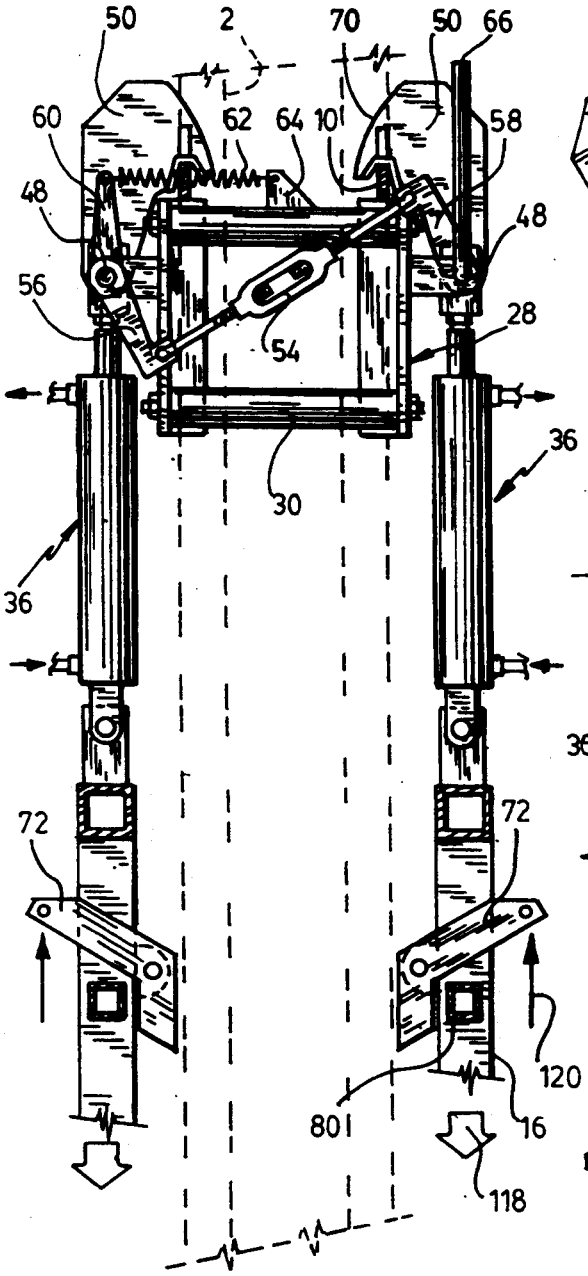
FIGS. 9 and 9A are vertical sections similar to that of FIGS. 7 and 7A, but taken just on the outside of the inner sleeve and showing two positions of the hooks and latching levers during the descent of the outer sleeve.
Figure 9A:
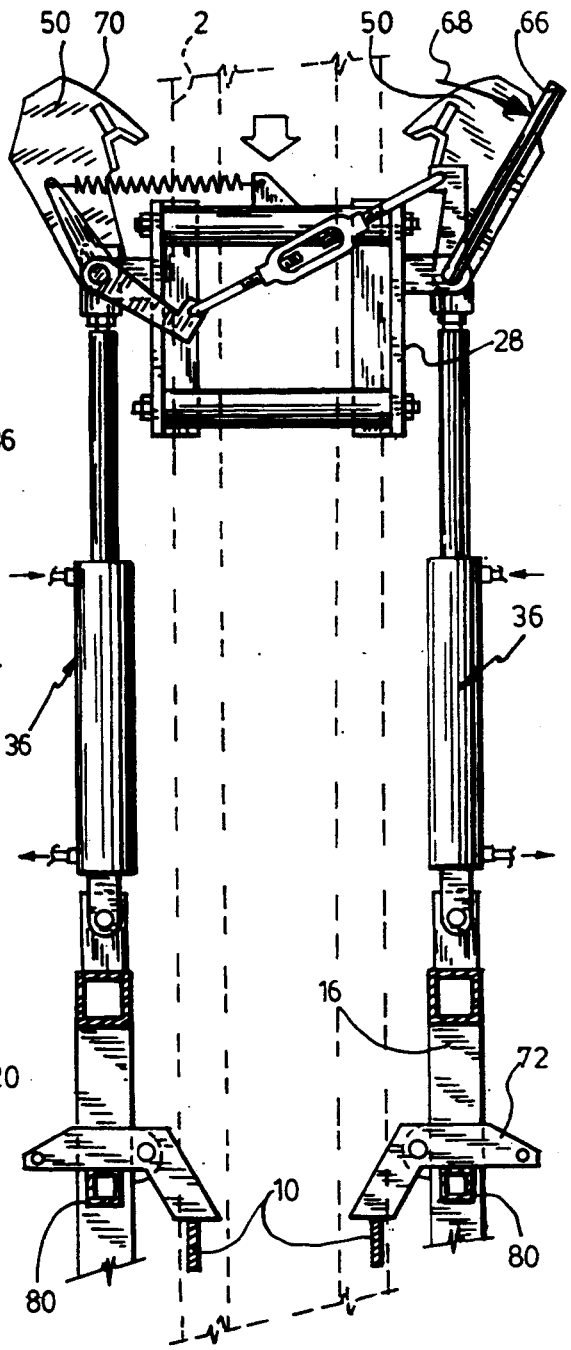
Figure 10:
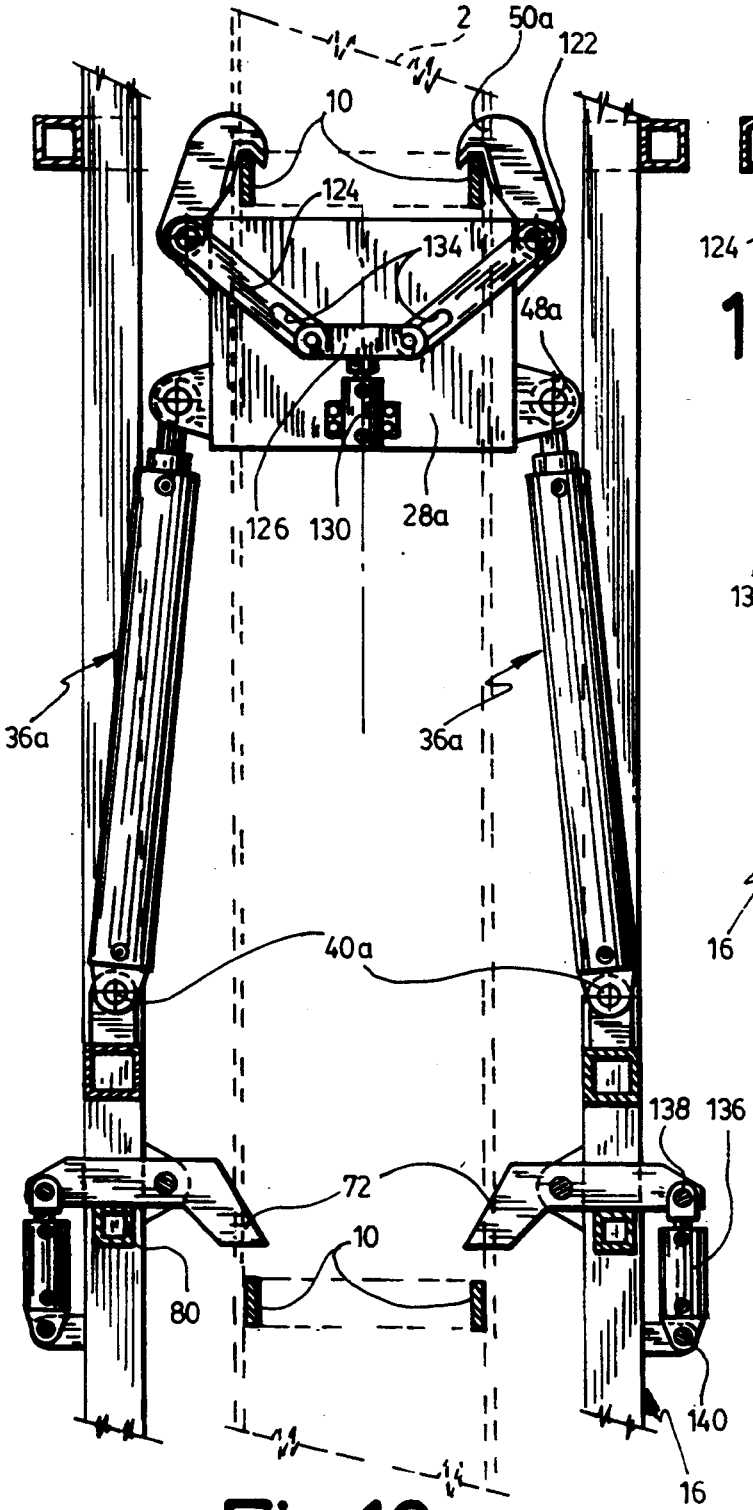
FIG. 10 is a vertical section of a modified embodiment, said section being similar to that of FIG. 9, but in which the hooks and latching levers are operated by double-acting power rams.
Figure 11:
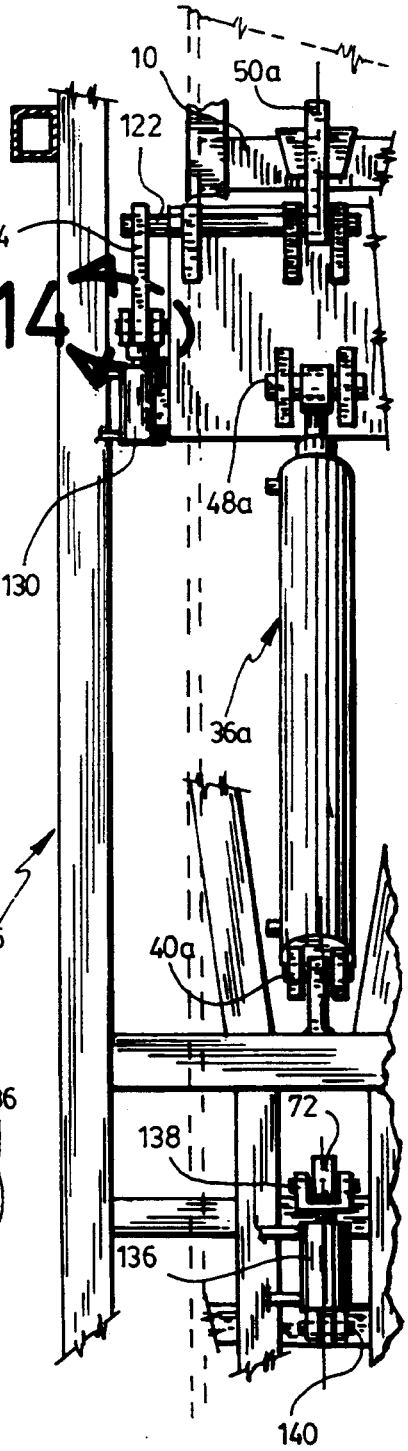
FIG. 11 is a partial view taken at right angles to that of FIG. 10.
Figure 12:
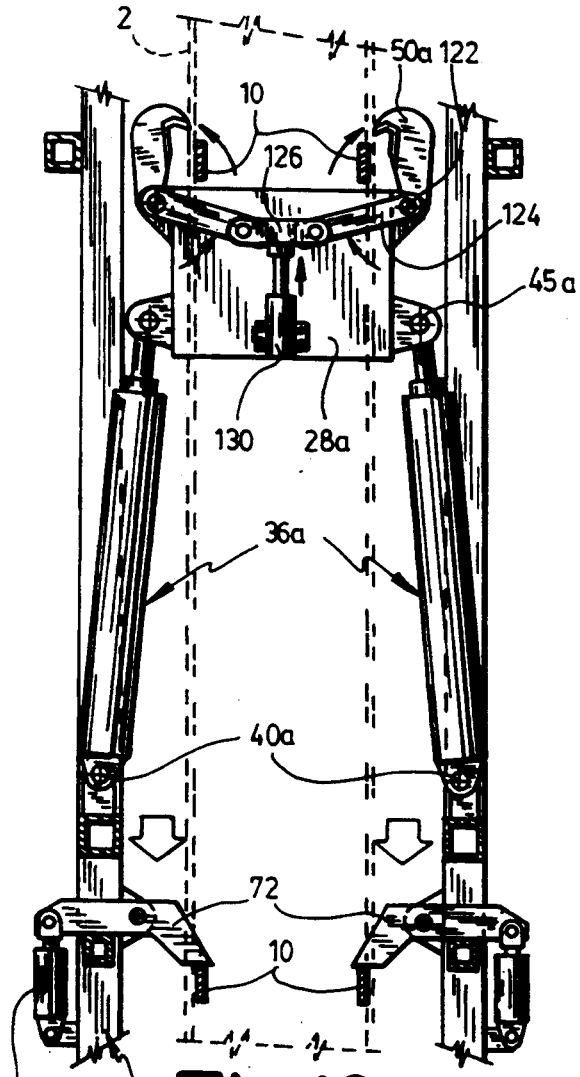
FIGS. 12 and 12A are views similar to that of FIG. 10, at different stages of the lowering movement of the outer sleeve.
Figure 12A:
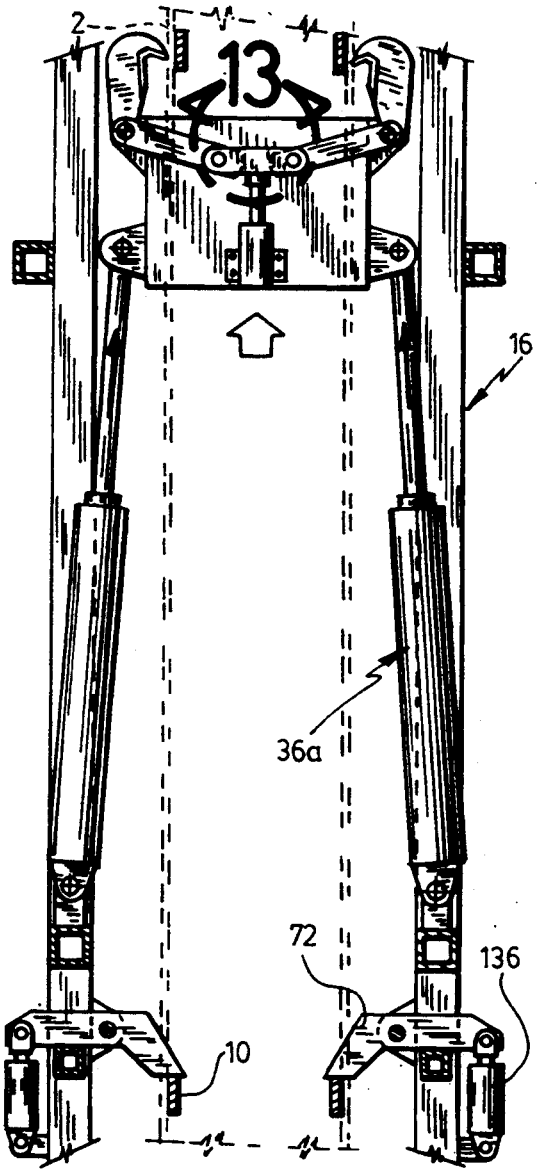
Figure 13:
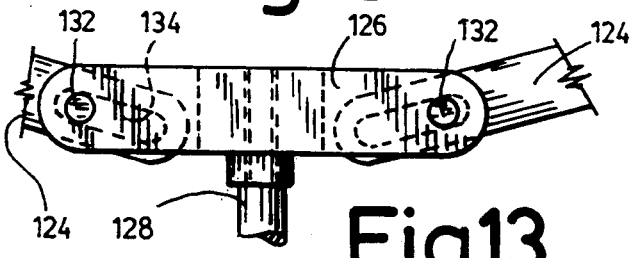
FIG. 13 is an enlarged elevation of the elements within circle 14 of FIG. 11.
Figure 14:
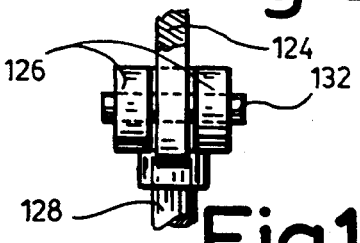
FIG. 14 is a partial end view of the elements of FIG. 13.
Figure 15:
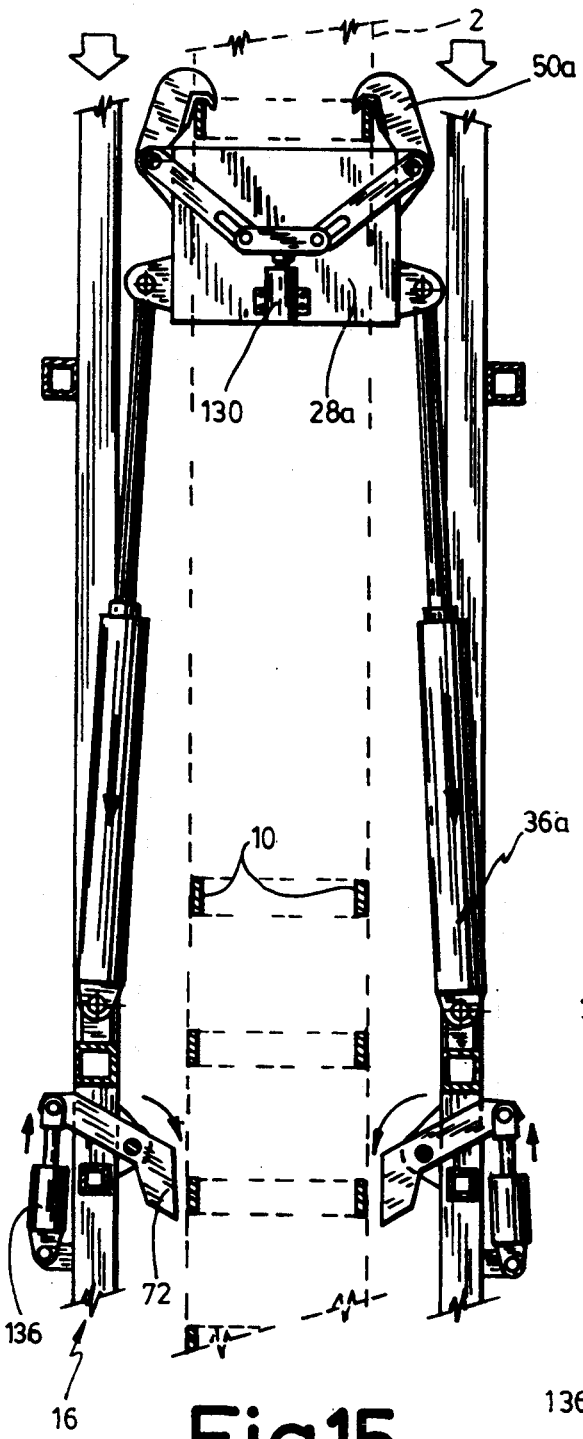
FIGS. 15 and 15*a* are views similar to FIGS. 12 and 12A at different stages of the vertical movement of the outer sleeve along the tower.
Figure 15A:
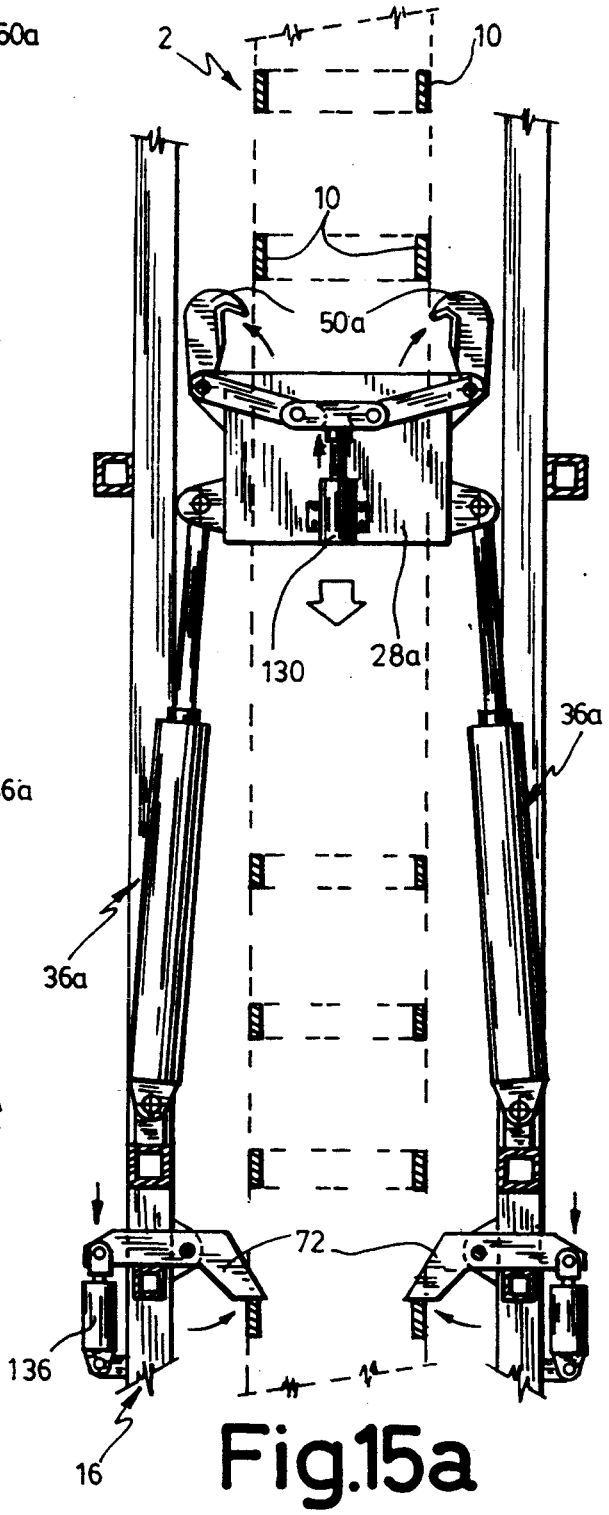

The inner sleeve 28 is reciprocated with respect to the outer sleeve 16 by means of a pair of power actuated rams 36, preferably double-acting hydraulic rams, which are disposed along the two opposite sides of the tower 2 which are normal to the slit side thereof. The cylinder 38 of each ram 36 is pivoted at its lower end at 40 to the outer sleeve 16 while the upper end of its piston rod 42 is provided with a yoke 44 (see FIGS. 5 and 6) freely pivoted on a pivot pin 48 carried by a pair of brackets 49 which are fixed to the inner sleeve 28 on opposite sides thereof which are normal to the back slit side of said inner sleeve. A hook 50 is fixed to each pivot pin 48 by means of a transverse locking pin 52, each hook 50 can pivot independently of the yoke 44 in a vertical plane parallel to the back side of the tower 2 between a rung hooking position as shown in FIGS. 5, 7, and 9 and a rung unhooking position as shown in FIG. 9A. There are two hooks 50 mounted on the two sides of the inner sleeve 28 which are normal to its slit side. The hooks therefore pivot in opposite directions to move from their hooking to their unhooking position and vice and versa. This movement is synchronized and reverse pivoting is obtained by the means shown in FIGS. 9 and 9A, namely a turn-buckle 54 which links a downwardly inclined arm 56 and an upwardly inclined arm 58 which are respectively fixed to the pivot pins 48 of the opposite hooks 50. The pivot pin 48 which carries the downwardly extending arm 56 also carries a biasing arm 60 which upwardly extends and is attached to a tension spring 62 attached at its opposite end to a support 64 fixed to the inner sleeve 28. Tension spring 62 biases the two hooks towards rung hooking position.

A manually actuated handle 66 is fixed to the pivot 48 provided with the upwardly extending arm 58 and serves to manually pivot the two hooks 50 towards rung unhooking position as shown by arrow 68 in FIG. 9A.

Each hook 50 has a top inclined edge 70 which in the path of the successive rungs 10 in the hooking position of the hooks. During raising movement of the inner sleeve, the next upper rungs will engage the inclined edge 70 of the hooks 50 and cause outer pivoting movement of the hooks to clear the rungs against the bias of the tension spring 62 whereby the hooks clear the rungs so engaged by the upwardly moving hooks; after clearing of the rungs, the hooks automatically return to their hooking position under the action of the tension spring 62. The rams 36 are double-acting and their stroke is at least equal to the pitch of the tower rungs 10, i.e. to the vertical distance between successive rungs 10.

Figure 7A:
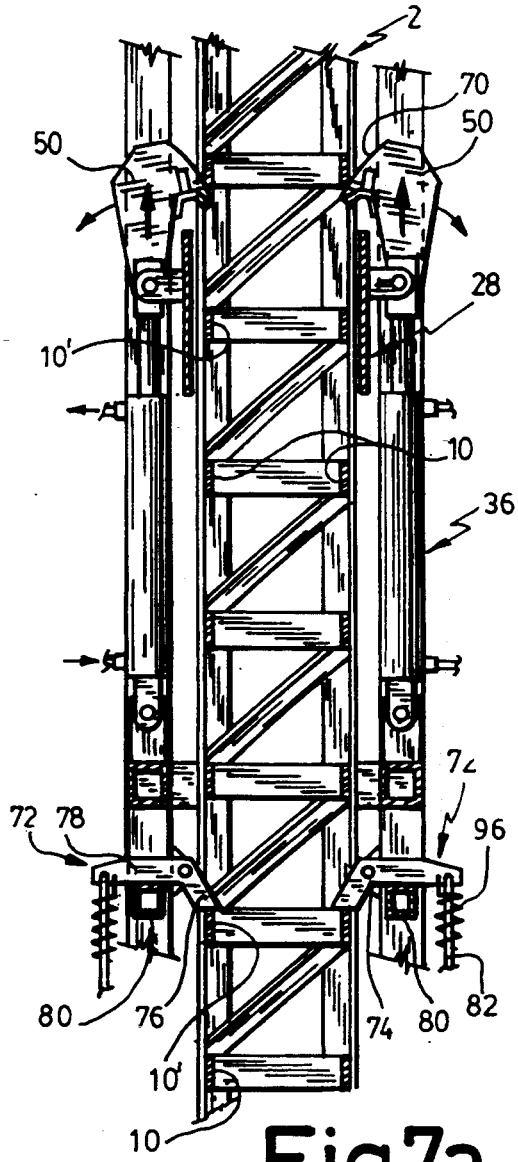

Latching means are also provided to latch the outer sleeve 16 to the tower 2 when the hooks 50 are in rung unhooking position. These latch means are shown in FIGS. 7 to 9A. They consist of a pair of latching levers 72 pivoted intermediate their ends at 74 to the outer sleeve 16 below the rams 36. Each latching lever 72 has an inner downwardly inclined branch 76 and an outer branch 78 on the inside and outside of the pivot 74 respectively; each latching lever can pivot in a vertical plane between a rung latching position as shown in FIGS. 7, 7A, and 9A, and a rung unlatching position as shown in FIG. 9. In the rung latching position, each outer branch 78 extends horizontally and rests on top of an abutment 80 which is formed by a cross-member of the outer sleeve 16 while the inner branch 76 has its free end in the path of the tower rungs 10, therefore resting on one of said rungs when at the appropriate level as shown in FIG. 7A. Each outer branch 78 extends outwardly on the outside of the outer sleeve and is pivotally attached to a rod 82 which extends downwardly.

Figure 8:
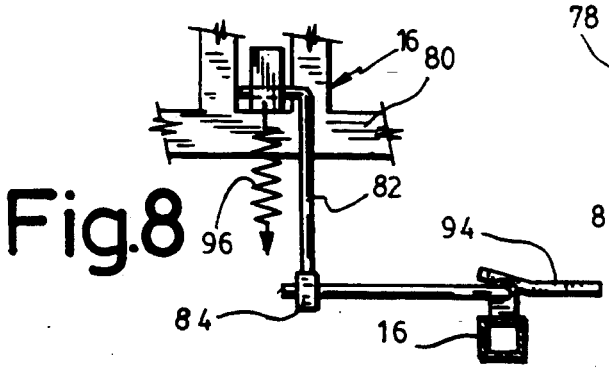
FIG. 8 and 8A are partial views taken along line 8—8 of FIG. 7, showing how the pedal moves the latching levers to rung unlatching position.
Figure 8A:
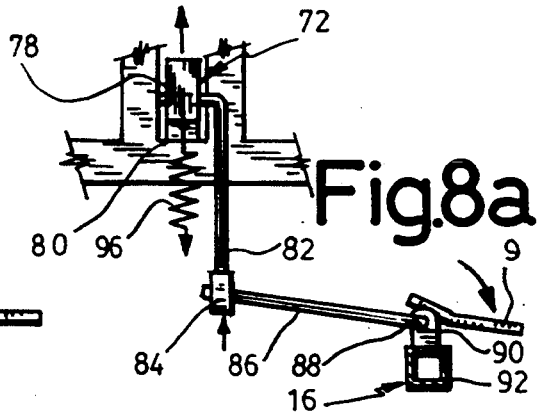

The lower ends of the two rods 82, one for each latching lever 72, have a ring 84 (see also FIG. 1) which is engaged by a branch of a U-shaped lifting rod 86 pivoted at 88 to brackets 90 mounted on an outer sleeve frame member 92 and actuated by a foot operated pedal 94 (see FIGS. 8 and 8A). Upon depression of the pedal 94 by an operator, the outer branches 78 of both latching levers 72 can be lifted to pivot latching levers 72 to their rung unlatching position shown in FIG. 9 wherein the inner branches 76 extend vertically downwardly and outwardly clear the tower rungs 10. The action of the pedal 94 is exerted against the bias of two tension springs 96 attached to the outer branch 78 of each latching lever 72 and downwardly extending and attached to the outer sleeve 16 at an appropriate location. Preferably, the tension springs 96 freely surround the respective rods 82.

The rams 36 are double-acting hydraulic piston and cylinder units fed by hydraulic liquid lines 98 which are removably connected in a hydraulic circuit to a hydraulic pump 100 (see FIG. 1) driven by an internal combustion engine 102 which has a gasoline reservoir 104. The hydraulic circuit has the usual hydraulic liquid reservoir 106. Preferably, the pump 100, engine 102, gasoline reservoir 104 and hydraulic reservoir 106 form a portable unit 108 which is removably carried by the outer sleeve 60 and which may be disconnected from the hydraulic lines 98.

Therefore the portable power unit 108 can be used on one tower to raise or lower the outer sleeve 16 and the platforms carried thereby; upon completion of the raising or lowering operation, the hydraulic lines are disconnected and the unit 108 is carried to another tower for raising or lowering its associated outer sleeve. It is possible to raise the outer sleeves of adjacent towers one after the other up to 10 feet when at least a central section of the platform extending between the same is pivotally hooked to the platform sections carried by the outer sleeves in such a manner that the central section can take a temporary inclined position during the time the outer sleeves of the two adjacent towers are not at the same level.

Although the hydraulic reservoir 106 is being shown as part of the a portable power unit 108, it is possible to form the hydraulic reservoir within the tubular members 17 forming the lower portion of the outer sleeve 16 thus decreasing the weight of the portable unit 108 which has to be carried from tower to tower.

Of course, a power unit could be permanently mounted on each outer sleeve 16 but this would be a more expensive solution since raising or lowering of a work platform is effected only a few times during a working day.

The system operates as follows, reference being made to FIGS. 7, 7*a*, 9, and 9*a*. During raising of the outer sleeve 16 as shown in FIG. 7 by arrows 110, the hooks 50 are hooked onto a pair of opposite rungs 10' and the hydraulic rams 36 are retracting. The latching levers 72 are in their rung latching position and their top inclined edge 112 is in the path of the rungs 10'' so that continued upward movement of the outer sleeve 16 will cause the top edges 112 to abut against the underside of the next rungs 10' and this will cause pivotal movement of the latching levers 72 toward their unlatching position thus clearing the rungs 10''.

Once the rams 36 have nearly reached their retracted position, the latching levers 72 are sufficiently above the rungs 10'' to pivot to their latching position. Movement of the rams 36 is then reversed and thus they extend: the outer sleeve is slightly lowered until the latching levers 72 come to rest on the rungs 10''. Continued extension movement of the rams 36 causes the hooks 50 to disengage the rungs 10' and move upwardly until their top inclined edge 70 contact the next higher rungs 10''' and this causes outward movement of the hooks 50 as shown in FIG. 7A against the bias of the tension springs 62. Once the hooks 50 have cleared the rungs 10''', the hooks automatically return to their latching position and hook the rungs 10'''. The rams 36 retract and the cycle is repeated.

It is noted that the raising movement is not continuous and, moreover, the outer sleeve must move down to a certain extent to allow clearance of the rungs by the latching levers 72.

Reversing movement of the rams 36 which are connected in parallel, is accomplished by operating the control lever 114 of a control reversing valve 116 as shown in FIG. 1. The control valve 116 is so located that the operator stands in front of the hooks 50 and latching levers 72 and can therefore monitor the operation so that the hooks and levers are hooking and latching at the proper time.

Since the rams 36 exert an upward and a downward force equally and simultaneously on opposite sides of the inner sleeve, the latter cannot wedge against the tower. Moreover, the hooks 50 can be made very short and stout and therefore they are properly guided to move in and out in a vertical plane and without distortion. The hooks 50 and rams 36 suspend the outer sleeve 16 from opposite sides of the tower, therefore there is no distortion or wedging effect on the outer sleeve or on the tower. Also, if a hook 50 or a latching lever 72 fail or break, the other hook 50 or lever 72 is strong enough to support the load.

FIG. 9 and 9A show the operation during lowering of the outer sleeve in accordance with the arrows 118. The hooks 50 being hooked onto a pair of opposite rungs, as shown in FIG. 9, the rams 36 are caused to extend after the pedal 94 has been actuated to keep the latching levers 72 in rung unlatching and clearing position (see arrows 120). The outer sleeve descends and, prior to the full extension of the rams 36, the pedal 94 is released and the latching levers 72 comes into latching engagement with a pair of opposite rungs 10. Descending movement of the outer sleeve 16 is stopped and thus, & during further extension of the rams 36, the hooks 50 move upwardly from the rungs to which they were hooked. At that point, the operator moves handle 66 in the direction of arrow 68 (see FIG. 9A) to move the hooks to their rung unhooking position. While keeping this position, the control valve lever 114 is operated so as to reverse the direction of the rams 36 which now are caused to retract. The inner sleeve is lowered and the handle 66 is finally released so that the tension spring 62 moves the two hooks 50 inwardly ready to engage the next lower pair of rungs 10. Further retraction of the rams 36 moves the latching levers 72 upwardly to clear the rungs on which they were resting, they are then pivoted to their unlatching position by means of the pedal 94 and then the cycle is repeated to accomplish another descending step.

A second embodiment of the invention is illustrated in FIGS. 10 to 15A. The improvement over the first embodiment consists in the fact that both the hooks 50 and the latching levers 72 are power operated for pivoting movement between their two positions. The double-acting hydraulic rams 36A are pivoted to the outer sleeve 16 at the lower pivot 40A and to the inner sleeve 28A at the upper pivots 48A. The hooks 50A are pivoted to the inner sleeve 28A by pivot pins 122 to which is attached an operating arm 124. The two operating arms 124 are downwardly converging and pivotally attached to a double connecting bar 126 which is fixed to the upper end of the piston rod 128 of a double-acting cylinder and piston unit 130 fixed to the front side of the inner sleeve 28A. The connecting bar 126 is pivotally connected to each operating arm 124 by pivot pins 132 which are slideable and rotatable within slots 134 made in each operating arm 124. Extension and retraction of the hydraulic ram 130 causes rung unhooking and rung hooking movement of the two hooks 50A respectively. It is noted that the tension spring 62 and the handle 66 of the first embodiment are eliminated.

Similarly, each latching lever 72 is pivotally connected at its outer end to a double acting hydraulic ram 136 by means of pivot 138. The other end of the ram 136 is pivotally connected at 140 to their outer sleeve 16. The pedal system 94 together with the rods 82, 84, 86 and the tension spring 96 of the first embodiment are eliminated.

The raising and lowering movement of the outer sleeve by the reciprocating movement of the inner sleeve is similar as in the first embodiment, except that rams 130 and 136 can be automatically operated in association with the rams 36 to operate the hooks 50A and the latching levers 72 at the proper time.

Figure 16:
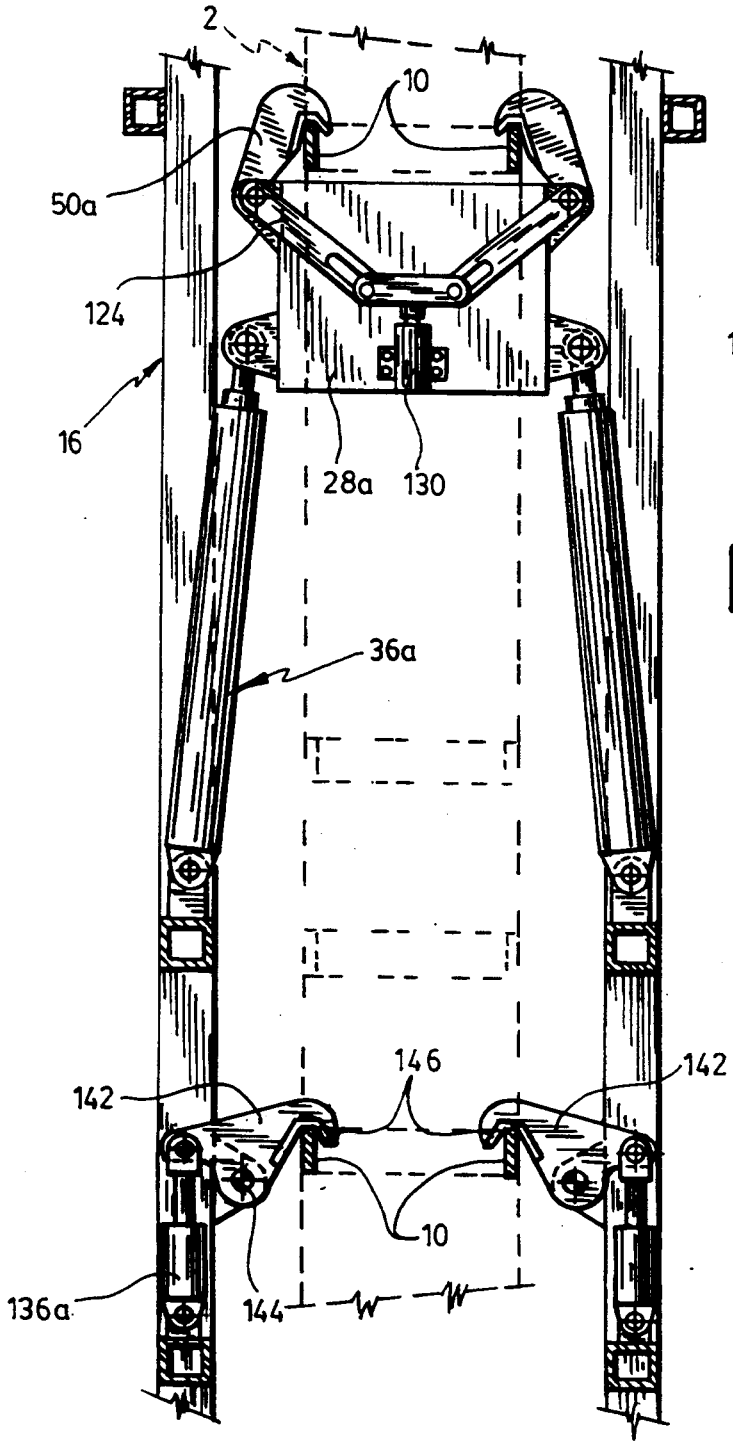
FIG. 16 is a view similar to FIG. 15 but showing a modified embodiment of the latching levers.
Figure 17:
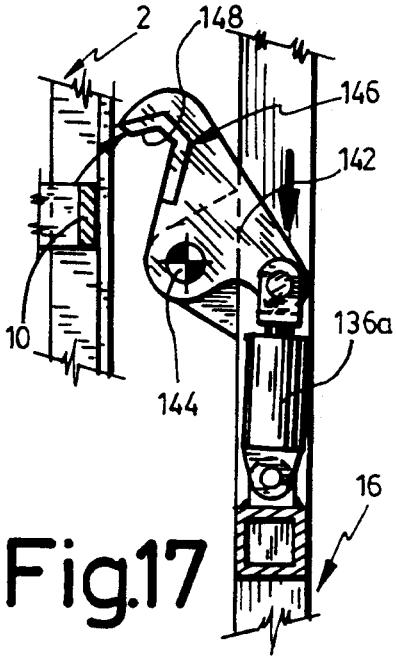
FIG. 17 is an enlarged view of one of the latching levers of FIG. 16 in its unlatching movement.
Figure 18:
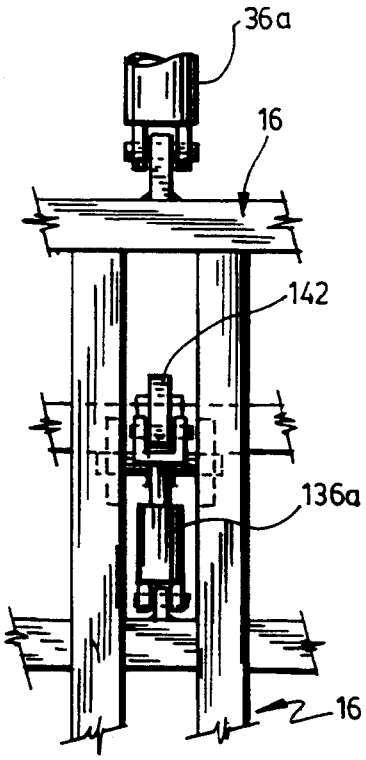
FIG. 18 is a partial elevation looking to the right of FIG. 16.

FIGS. 16 to 18 show a third embodiment in which the arrangement of the inner sleeve 28A, rams 36A, hooks 50A, operating arms 124 and double-acting ram 130 is exactly the same as in the second embodiment. The only difference lies in the type of latching levers used. These latching levers are shown at 142. They are freely pivoted at 144 to the outer sleeve 16 and their outer branches pivotally connected to double-acting ram 136A also pivoted to the outer sleeve. The inner branch of the latching lever 142 is hook-shaped as shown at 146. This hook-shape forms a downwardly opening V, such that its inclined edge 148 is about tangent to a circle having its center at the pivot 144. The same shape is imparted to the hooks 50A of FIGS. 10 to 15A. With such a hook shape, it has been found that the load can be transferred from the hooks 50A to the latching levers 142 and by vice and versa during a stop of the outer sleeve without having to reverse the movement of the outer sleeve to clear the hooks from the rungs.

Figure 19:
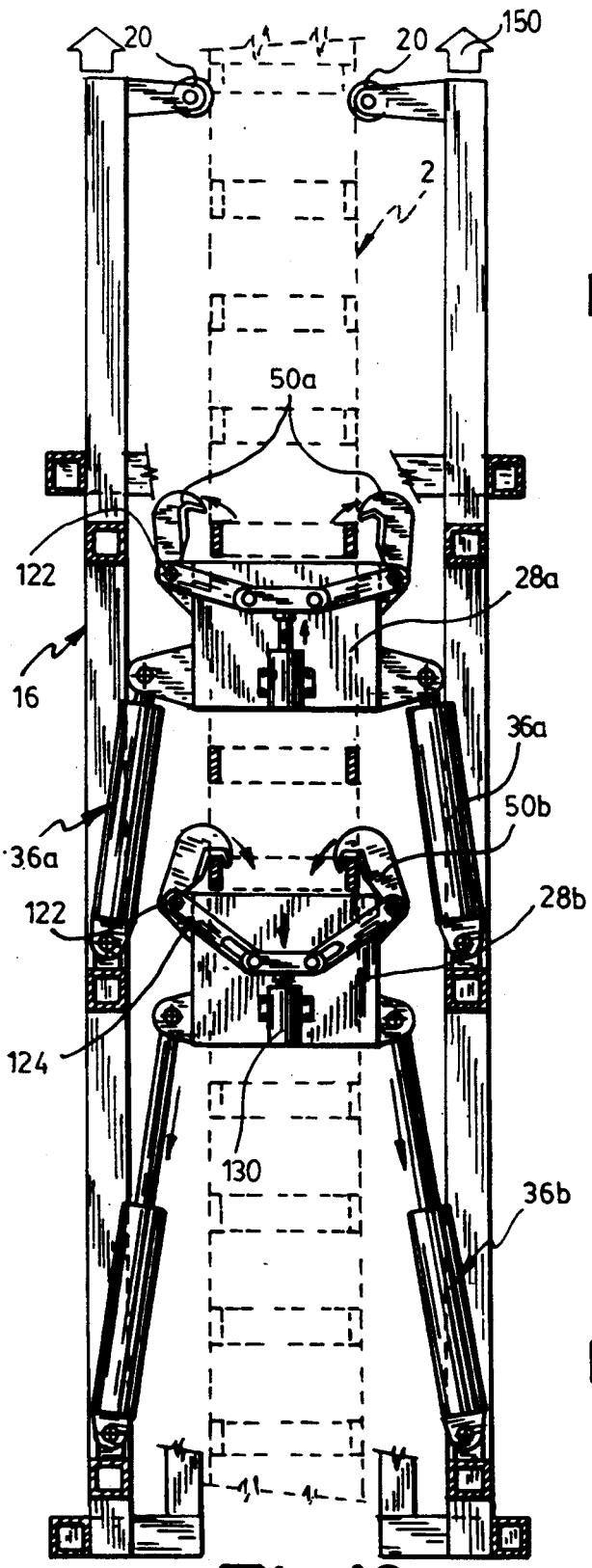
FIGS. 19, 19A, 20 and 20A are front views of another embodiment showing vertical sections similar to that of FIG. 15, being a double continuously raising and lowering system illustrated at different stages of its operation.
Figure 19A:
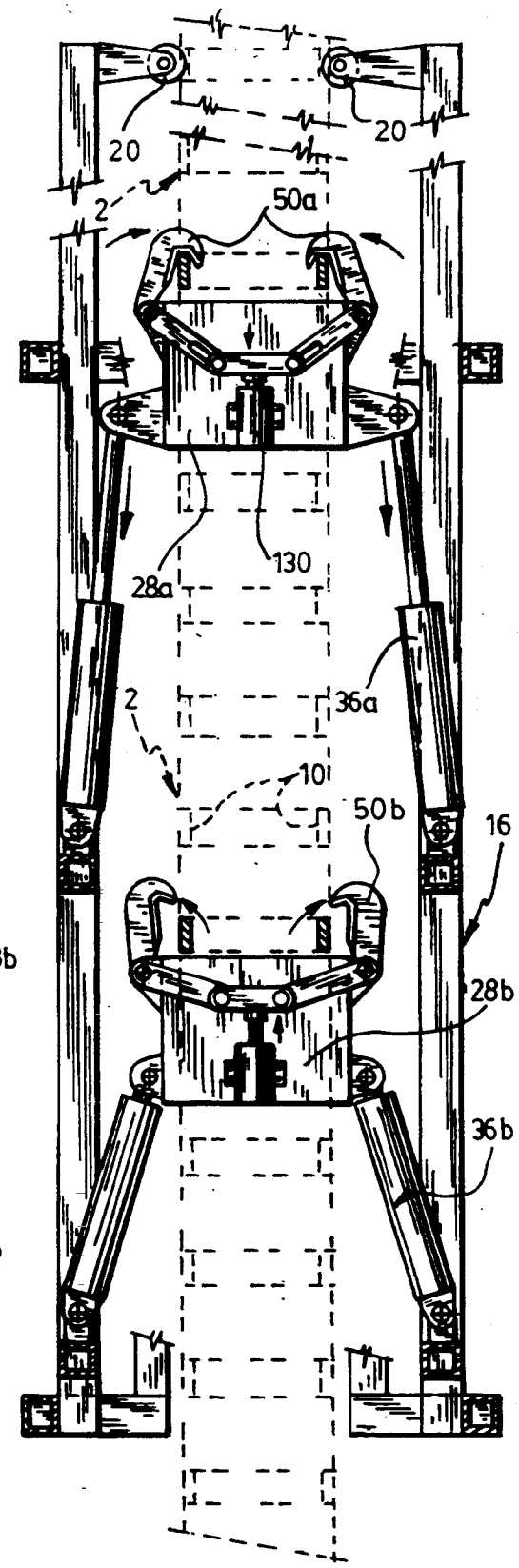
Figure 20:
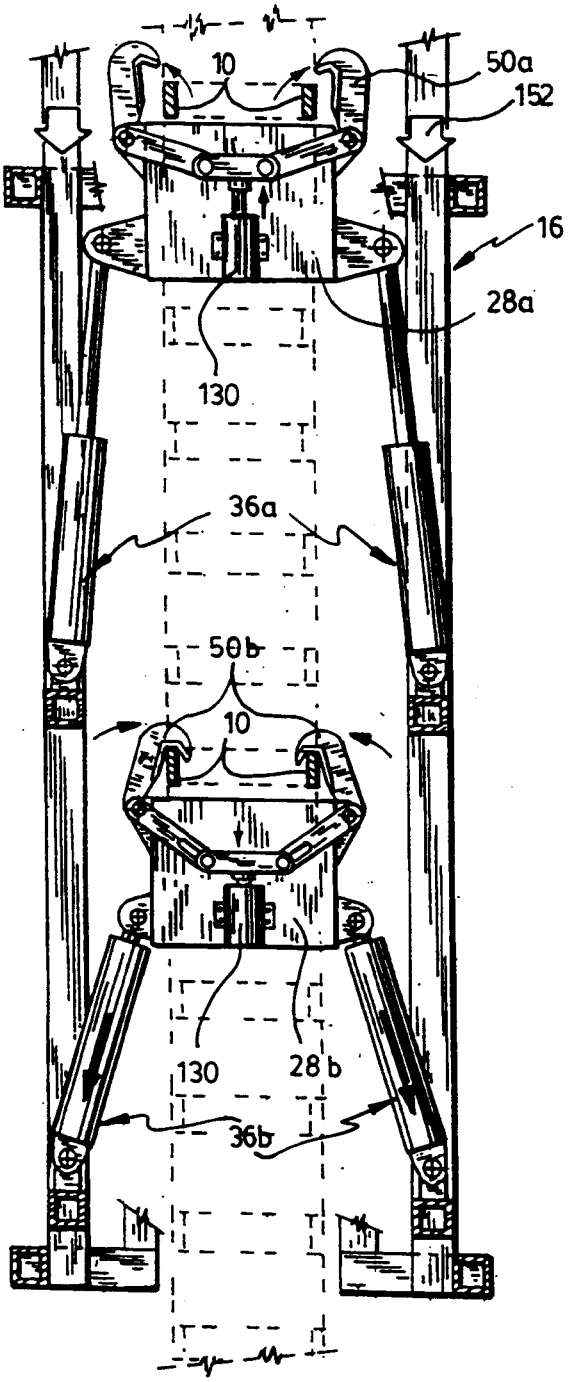
Figure 20A:
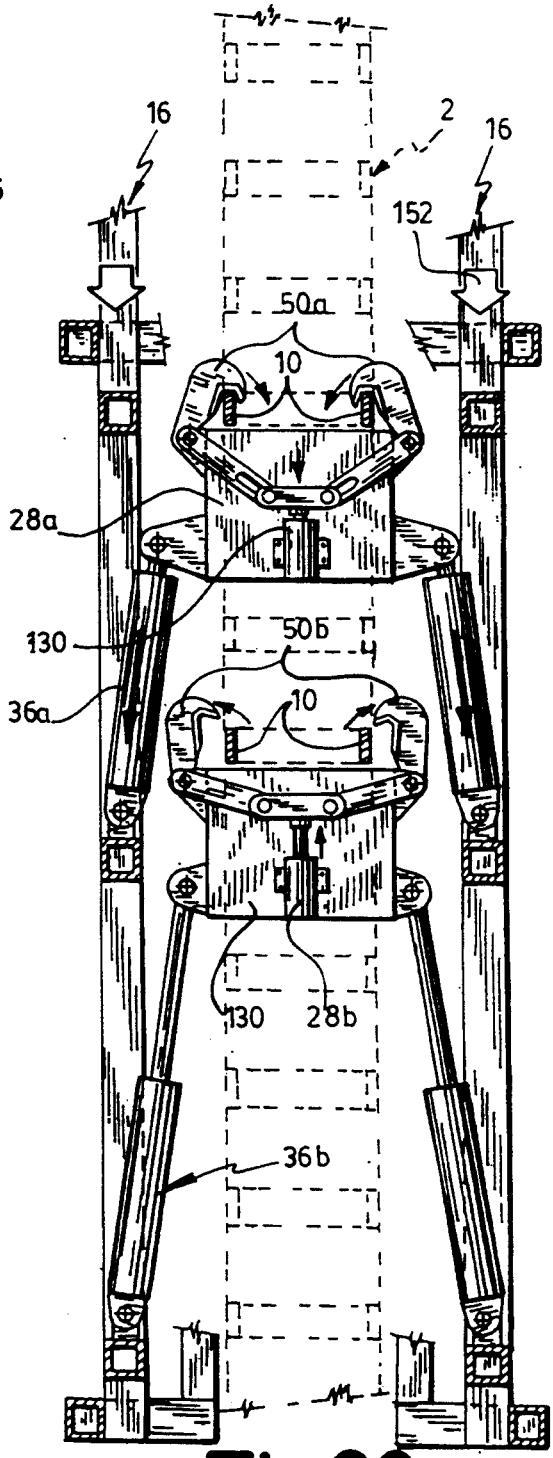

A fourth embodiment is shown in FIGS. 19 to 20A. The outer sleeve 16 is as in the other embodiments, the latching levers 72 or 72A or 142 and their operating system are replaced by a second inner sleeve 28B which is the same as the first named inner sleeve 28A is disposed below the same and also carries hooks 50B, pivot pins 122, operating arms 124, bar 126 and double-acting hydraulic ram 130. The sleeve 28A and the above-noted parts are the same as in the third embodiment. The second inner sleeve 28B is operated by a pair of rams 36B as in the third embodiment.

The outer sleeve 16 is sufficiently long so that the vertical distance between its guiding rollers 20 at the top and bottom of the outer sleeve 16 is sufficient to permit reciprocating movement of the two inner sleeves 28A, 28B with respect to the outer sleeve 16, both through a stroke a little more than the vertical distance between two successive rungs 10. This fourth embodiment operates as follows:

Referring to FIG. 19, the hooks 50B of the lower sleeve 28B are hooked to a pair of rungs 10, their rams 36B are retracting and the outer sleeve is being raised as shown by arrows 150. The rams 36A immediately starts to extend and the hooks 50A open before the lower rams 36B have completed their retracting movement, and the hooks 50A clear the to of a pair of rungs. At that point, the hooks 50A close and the rams 36A start to retract, whereby the load is transferred to the top hooks 50A. The lower hooks 50B move upwardly along with the outer sleeve and, once they have cleared their rungs, they open under the action of the rams 36B. The same movement is repeated for the lower sleeve so that a continuous upward movement of the outer sleeve is obtained, the load being smoothly transferred from one pair of hooks to the other without any stop and reverse movement of the outer sleeve. It will be noted that the hooks 50A and 50B alternately serve as latching levers.

FIGS. 20 and 20A show the relative movements of the rams 36A and 36B and hooks 50A and 50B during the descending movement of the outer sleeve along the tower as shown by arrows 152.

I claim:

1. A self-raising work platform assembly comprising a tower having vertically equally spaced rungs, anchor means attached to and laterally protruding from said tower at vertically spaced points along said tower for attachment; to an adjacent building structure, an outer sleeve and an inner sleeve a partially surrounding said tower and guided for up and down movement along said tower while clearing said anchor means, support means carried by said outer sleeve to support a work platform, said inner sleeve located between said outer sleeve and said tower, at least two double-acting power rams pivotally connected at their ends to said outer and inner sleeves for effecting reciprocating up and down movement of said inner sleeve relative to said outer sleeve a distance at least equal to the distance between two adjacent rungs, said rams spaced from each other around said inner sleeve, at least two hooks pivotally mounted on and spacedly disposed around said inner sleeve, and means to pivot said hooks between rung hooking and rung unhooking positions.

2. A self-raising work platform assembly as defined in claim 1, wherein said tower, said outer sleeve and said inner sleeve have a four-sided quadrangular cross-section, said anchor means are attached and are laterally protruding from one side of said tower and said outer and inner sleeves have, on one side, a longitudinal slit opening at both ends thereof to clear said anchor means, and wherein said rams and hooks are disposed on two opposite sides of said sleeves, normal to the slit side thereof.

3. A self-raising work platform assembly as defined in claim 2, wherein said outer sleeve carries tower engaging guiding means at both end portions thereof, the vertical distance between said guiding means being sufficient to permit reciprocating up and down movement of said inner sleeve relative to said outer sleeve.

4. A self-raising work platform assembly as defined in claim 3, further including latch means to latch said outer sleeve to said tower when said hooks are in rung unhooking position.

5. In a self-raising work platform assembly as defined in claim 4, further including biasing means biasing said hooks towards their rung hooking position and wherein each hook has a top inclined edge which causes movement of said hook towards its rung unhooking position upon engagement of the next upper rung to thus clear said next upper rung when said inner sleeve moves up along said tower.

6. A self-raising work platform assembly as defined in claim 4, further including a handle means connected to said hooks to manually pivot the same between rung hooking and unhooking positions.

7. A self-raising work platform assembly as defined in claim 1, wherein said rams are hydraulic rams add further including a portable power unit including an internal combustion engine, and a hydraulic pump driven by said engine and removably connected to said rams, said power unit removably carried by said outer sleeve.

8. A self-raising work platform assembly as defined in claim 4, wherein said latch means includes at least two latching levers pivoted by a pivot intermediate their ends to said outer sleeves at spaced points around said outer sleeve, each latching lever having an inner branch and an outer branch extending inwardly and outwardly of said pivot respectively, said outer sleeve having an abutment outwardly of said pivot and in register with and below said outer branch, each lever pivotable in a vertical plane between a rung latching position in which said inner branch overlaps and can rest on one of said rungs, and said outer branch overlaps and rests on said abutment, and a rung unlatching position wherein said inner branch extends exteriorly of and clears said rungs.

9. A self-raising work platform assembly as defined in claim 8, further including biasing means attached to said latching levers and to said outer sleeve and biasing said latching levers towards latching position.

10. A self-raising work platform assembly as defined in claim 9, further including pedal means connected to said levers and foot-operated to pivot said latching levers to unlatching position upon depression of said pedal means.

11. In a self-raising work platform assembly as defined in claim 8, further including double-acting hydraulic rams connected to said outer sleeve and to said latching levers and pivoting said latching levers between rung latching and rung and unlatching positions.

12. A self-raising work platform assembly as defined in claim 11, further including a double-acting hydraulic ram connected to said inner sleeve and to said hooks and pivoting said hooks between rung hooking and rung unhooking positions.

13. A self-raising work platform assembly as defined in claim 4, further including a double-actina hydraulic ram connected to said inner sleeve and to said hooks and pivoting said hooks between said rung hooking and said rung unhooking positions.

14. In a self-raising work platform assembly as defined in claim 4, wherein said latching means includes two latching levers pivoted to said outer sleeve at spaced points around said outer sleeve for movement in a vertical plan between a rung latching position and a rung unlatching position and double-acting hydraulic ram means for pivoting said latching levers between rung latching and rung unlatching positions.

15. A self-raising work platform assembly as defined in claim 1, wherein said inner sleeve is a first inner sleeve, said power rams are first power rams and said hooks are first hooks, said first inner sleeve, said first power means and said first hooks forming a first tower climbing unit and further including a second tower climbing unit including a second inner sleeve partially surrounding said tower and guided for up and down movement along said tower while clearing said anchor means, said second inner sleeve located between said outer sleeve and said tower and vertically spaced from said first inner sleeve, at least two second power rams pivotally connected at their ends to said outer sleeve and to said second inner sleeve for effecting reciprocating up and down movement of said second inner sleeve relative to said outer sleeve a distance at least equal to the distance between two adjacent rungs and alternately with the reciprocating movement of said first inner sleeve, at least two second hooks pivotally mounted on and spacedly around said second inner sleeve, and means to pivot said second hooks between rung hooking and rung unhooking position alternately of the means to pivot said first hooks.

16. A self-raising work platform assembly as defined in claim 15, wherein said means to pivot said first hooks and said means to pivot said second hooks are first and second double-acting power rams connected to said first and second inner sleeves and to said first and second hooks respectively and pivoting said hooks between rung hooking and rung unhooking positions.

17. A self-raising work platform assembly as defined in claim 15, wherein said means to pivot said first hooks and said means to pivot said second hooks are first and second double-acting power rams connected to said first and second inner sleeves until said first and second hooks respectively and pivoting said hooks between rung hooking and rung unhooking positions.

* * * * *